US006964328B2

(12) United States Patent
Santilli, Jr. et al.

(10) Patent No.: US 6,964,328 B2
(45) Date of Patent: Nov. 15, 2005

(54) ANTITHEFT DESIGN FOR ROTARY COIN MECHANISMS

(75) Inventors: Richard A. Santilli, Jr., Cary, NC (US); Greg Beard, Raleigh, NC (US)

(73) Assignee: New Concept Vending, Cary, NC (US)

( * ) Notice: Subject to any disclaimer, the term of this patent is extended or adjusted under 35 U.S.C. 154(b) by 262 days.

(21) Appl. No.: 10/602,787

(22) Filed: Jun. 24, 2003

(65) Prior Publication Data

US 2004/0003979 A1 Jan. 8, 2004

Related U.S. Application Data

(60) Provisional application No. 60/391,764, filed on Jun. 26, 2002.

(51) Int. Cl.[7] ..... G07F 1/00; G07F 5/02
(52) U.S. Cl. ..... 194/202; 194/292; 194/237
(58) Field of Search ..... 194/202, 203, 194/200, 290, 291, 292, 232, 236, 237, 253, 194/254; 49/35; 222/2

(56) References Cited

U.S. PATENT DOCUMENTS

| | | | | |
|---|---|---|---|---|
| 683,280 A | | 9/1901 | Hofheimer | |
| 1,047,651 A | | 12/1912 | Kaighn | |
| 1,160,557 A | | 11/1915 | Wilton | |
| 2,537,317 A | | 1/1951 | Probasco | |
| 3,010,557 A | | 11/1961 | Weitzman | |
| 3,227,257 A | | 1/1966 | Probasco | |
| 3,604,547 A | | 9/1971 | Bolen | |
| 3,970,181 A | * | 7/1976 | Rubio | 194/237 |
| 4,131,190 A | | 12/1978 | Gitlin | |
| 4,350,239 A | * | 9/1982 | Tsuiki | 194/295 |
| 4,673,074 A | * | 6/1987 | McCormick | 194/236 |
| 4,702,392 A | | 10/1987 | Rachman | |
| 5,234,093 A | | 8/1993 | Abe et al. | |
| 5,337,876 A | | 8/1994 | McGee et al. | |
| 5,383,545 A | | 1/1995 | Schwarzli | |
| 5,657,848 A | | 8/1997 | Schwarzli | |
| 5,950,793 A | * | 9/1999 | Schwarzli | 194/236 |
| 5,954,181 A | * | 9/1999 | Schwarzli | 194/324 |
| 5,996,841 A | | 12/1999 | Marrocco | |
| 6,076,650 A | | 6/2000 | Schwarzli | |
| 6,253,900 B1 | * | 7/2001 | Watanabe | 194/233 |

OTHER PUBLICATIONS

Operating and Service Manual—Price Adjustable Rotary Coin Mechanism.

* cited by examiner

*Primary Examiner*—Donald P. Walsh
*Assistant Examiner*—Mark J. Beauchaine
(74) *Attorney, Agent, or Firm*—The Eclipse Group; Kevin E. Flynn

(57) ABSTRACT

A method and apparatus for an improved rotary coin mechanism that prevents the theft of vending machine items by preventing the maintained presence of a theft tool used by a thief to interfere with the operation of a coin detector so that a coin slot without a coin of the prescribed size can be rotated past the coin detector to allow product to vend without the insertion of a coin of the prescribed size. The invention closes a gap between the rotating coin disc and the mechanism casing after a coin slot has entered into the rotary coin mechanism casing so that the theft tool cannot be maintained in an inserted position for a sufficient range of rotation of the rotary coin mechanism handle. The invention applies to rotary coin mechanisms that require one or more coins in order to obtain the vended item.

17 Claims, 11 Drawing Sheets

ANTITHEFT DESIGN FOR ROTARY COIN MECHANISMS

This application claims priority to U.S. Provisional patent application No. 60/391,764 filed on Jun. 26, 2002 for Antitheft Design for Rotary Coin Mechanisms.

In order to promote clarity in the description, common terminology for components is used. The use of a specific term for a component suitable for carrying out some purpose within the disclosed invention should be construed as including all technical equivalents which operate to achieve the same purpose, whether or not the internal operation of the named component and the alternative component use the same principles. The use of such specificity to provide clarity should not be misconstrued as limiting the scope of the disclosure to the named component unless the limitation is made explicit in the description or the claims that follow.

BACKGROUND OF THE INVENTION

1. Technical Field

The present invention relates to coin mechanisms, particularly to those that are mechanical in nature, employing rotary coin recognition techniques. Typical rotary coin mechanisms use levers to recognize the lack of a coin of appropriate size. The lack of a coin of the appropriate size prevents sufficient rotation of the rotary coin mechanism to trigger the vending of the requested good or service.

2. Description of Prior Art

In machines using mechanical rotary coin mechanisms, upon insertion of the proper coinage, the cam of the device is rotated, and the coin's movement internal to the device moves the coin detection levers out of the way, allowing for complete rotation of the cam and dispensing the vended product. Incorrect coinage will not move the coin detection levers out of the way to allow the cam to rotate, and no product is vended. Rotary coin mechanisms have been known in the art for a number of decades.

The environment for the rotary coin mechanism is illustrated in FIG. 11 where a representative set of components is shown in a cut-away view of a vending machine 1104. When appropriate coins are placed in the top of rotary coin mechanism 1116 and the rotary coin mechanism handle is rotated, the coins drop into the coin box 1120 and the rotary coin mechanism 1116 interacts with the vending machine to cause rotation of a large coil 1112. Rotation of the coil 1112 causes an auger effect to convey a vending item 1124 forward so that the vending item 1124 drops and can be accessed through the access door 1108.

There are advantages to using a mechanical rotary coin mechanism as these devices offer relatively reliable service and work without electricity. Many machines use multiple rotary coin mechanisms. For example a machine may have one mechanism per row per item with many rows for multiple items. The use of multiple mechanical coin mechanisms means that the machine will continue to accept coins and vend at least some products if some of the mechanical coin mechanisms are still in service. This is an advantage over vending machines using a single electronic coin mechanism where a failure of the single mechanism prevents sale of any vending items until the coin mechanism is repaired or replaced.

A problem with these mechanical rotary coin mechanisms is the ability to defeat the lever and stop method of coin recognition with simple tools, such as paper clips or firm wires. Use of these simple tools upon the rotary coin mechanism will allow products to be vended without inserting the proper coinage. A vending machine that provides product without receiving the proper coins is not appropriate for use in an unsupervised location where thieves may steal the vended product.

The fully mechanical coin mechanism assembly is typically constructed of injection-molded plastic and glass reinforced parts for durability and ease of operation. These parts are designed for long reliability and simple usage, and should not fade, chip, or crack under normal usage. Mechanical coin mechanisms have distinct advantages over electronic coin mechanisms. Mechanical coin mechanisms require no electricity, allowing the devices to be used in places where power outlets are unavailable. Many vending or services machines have multiple coin mechanisms per machine, allowing for the instance when one coin mechanism is jammed or broken, all other mechanisms on the machine should still be fully functional, and the machine still generates revenue. Mechanical rotary coin mechanisms are essentially simple to disassemble, program, and reassemble, and do not require training in repairs of electrical devices.

To prepare a rotary coin mechanism for use in a vending machine, it must first be disassembled, and reassembled, programmed to the desired cost of the product to be dispensed or service requested. There are many different models of rotary coin mechanisms, programmable from five cents to several dollars, working on the same rotary principles.

The prior art design can be better explained through the use of FIGS. 1–7. FIG. 1 shows a perspective view of a rotary coin mechanism 100, more specifically, the front, top, and right side of a rotary coin mechanism 100 including back plate 116. When appropriate coins (one or more coins) are place into the rotary coin mechanism 100 through the coin opening 108 in front housing 104, a user may rotate a rotary handle 112 to trigger the vending of the selected product (not shown). As described below, if the proper coins are not inserted, then the rotary handle will be prevented from rotating a sufficient amount to trigger the vending of the selected product.

As shown in FIG. 2, the coin discs 204 may optionally be manufactured to accommodate several different size coins so that placement of the appropriately sized coin slot 208 into the assembled rotary coin mechanism changes the denomination (size) of the coin that is accepted into the coin disc. Alternatively, each coin disc can be made with a single coin opening. To change the required coinage, one would use the appropriate combination of coin discs and blanks. As described below, the interior channel 212 of the coin discs 204 allows the coin discs 204 to be stacked on a corresponding protrusion from the rotary handle.

As best shown in the exploded assembly drawing contained in FIG. 3, the rotary handle 112 has a handle protrusion 304 that fits within the cavity of the rotary coin mechanism 100. A set of coin discs 204 and filler discs 308 can be slid onto the handle protrusion 304 so that the discs rotate with the rotary handle 112 into the casing at the leading edge 310 of the casing. A set of coin detectors assemblies 312 interact with the coin discs (as explained below).

The back of the rotary coin mechanism 100 includes a rear housing 316 that is held to the rest of the rotary coin mechanism by a set of screws. Outside of the rear housing 316 is a ratchet 320, pawl 324 and pawl spring 328. Pressure from the pawl spring 328 pushes the pawl extension 332 to keep the pawl 324 engaged with the ratchet to prevent rotation of the rotary handle 112 against the pawl 324. A rotary coin mechanism protrusion 336 is connected to the ratchet and the rotary handle protrusions 304 so that the rotary coin mechanism protrusion rotates with the rotary handle to engage with other components of the vending machine to cause the vended item to be delivered. (rest of vending machine not shown). FIG. 4 shows the assembled rotary coin mechanism from the rear.

FIGS. 5 and 6 show the operation of the coin detector assemblies 312. Each assembly has a detector detent 504 and detector spring 508. The detector spring 508 biases the detector detent 504 to rotate around post 512 and engage any coin slot 208 that was supposed to receive a coin prior to rotating the rotary handle 112. Filler disc 308 has a concave gap 516 that is aligned with the coin slot 208 for each coin disc 204 programmed to receive a coin.

The detector detents 504, which are under spring pressure, stop rotation by interacting with the empty coin slot 208 that would normally be occupied by a coin (FIG. 6) as the coin slot 208 rotates toward the detector detent 504. Should the proper coinage be in the requisite positions, the coins would push the detector detents 504 out of the way while the rotary handle 112 is being rotated by the user. As the other coin slots 208 are matched with tabs (not shown) on the filler discs 308, the handle can continue to rotate without interference from the detector detents 504. The rotation of the handle and the attached components allows the coins to continue rotating until upside down from their original position. The upside down coins fall from the coin slots 208 into the coin catch box (not shown in FIG. 2). The rotating assembly will then continue being rotated by the user the final 180 degrees back to its original position, and the product or service will be dispensed.

The location and depth of the coin slots on the coin discs are such that improper coin insertion will not cause the detector detent 504 to move sufficiently out of the way to allow the assembly to rotate past the detector detent 504. Thus the assembly is blocked from making a full rotation and the product or service is not provided. For example, a dime inserted into the quarter slot will sit too low in the rotating disc to encounter the detector detent 504 lever and push the detector detent 504 out of the way. The same is true attempting to use a nickel in a quarter sized coin slot, or even a dime or penny inserted into the nickel sized coin slot.

The detector detent is shown blocking rotation in FIG. 6. FIG. 7 provides a better view of the detector springs 508 interacting with the spring side of the detector detents.

ASSEMBLY OF A ROTARY COIN MECHANISM

The rotary coin mechanism 100 detailed in FIG. 1 through FIG. 7 is an example of a four coin-accepting device. The rotary coin mechanism 100 can be programmed to vend with cost settings from five cents to one dollar using one to four coin slots 208 set to receive United States nickels, dimes, or quarters.

In order to program the rotary coin mechanism to the correct value, the programmer adjusts the coin discs 204, filler disc 308, detector detents 504 and spacers (not shown) internal to the device casing. As an example, to program the device to require thirty-five cents, the programmer would start by removing all coin discs 204, filler discs 308, detector detents 504 and spacers (not shown). The first disc would be placed over the handle protrusion 304 (FIG. 3) from the rear, with the twenty-five cent coin slot 204 in the coin disc 204 arranged such that is accessible through the coin opening 108 in the front housing 104. Next, a filler disc 308 would be added on top of the coin disc 204 with the concave gap 516 aligned with the quarter sized coin slot 208 of the coin disc 204. In order to program the device to thirty-five cents, the next coin disc would be inserted on top of the previous filler disc with the ten-cent slot aligned with the original twenty-five cent opening. Again, a filler disc 308 in the accepting position (with concave gap 516 aligned with the coin slot 208) would be inserted. Since the device is now programmed for thirty-five cents, the rest of the device needs to be filled so as to reject the insertion of additional coins.

This is accomplished by placing a coin disc 204 on top of the last filler disc 308 set to the ten-cent position (the smallest coin). The next filler disc 308 is then inserted rotated from the accepting position into a rejecting position. The rejecting position aligns a tab on the filler disc that overlaps the opening of the coin disc's ten-cent opening, preventing the insertion of a coin. As the tabs are on the front face of the filler discs 308, they are not visible in the drawings. The programming to reject a coin would then be repeated to fill the fourth and final coin slot.

Once the coin discs have been properly programmed, the rotary coin mechanism 100 must then be adjusted for coin detection. This is accomplished through use of the detector detents 504 (FIG. 7). For every pair of a coin disc 204 and filler disc 308 set in the accepting position, a detector detent 504 is inserted on a post 512 internal to the casing, and that detector detent 504 is in turn held flush against the coin disc by a detector spring 508 (FIG. 7). The detector detent 504 is designed to engage with the concave gap 516 of the filler disc 308 to prevent rotation without a coin in the paired coin disc 204. For every coin-rejecting disc, a spacer is placed on the post 512 until the post 512 is filled from top to bottom. In our example to program a four coin device to require thirty-five cents, the programmer would insert two detector detents 504 and detector springs, followed by two spacers (not shown).

PROBLEMS WITH THE PRIOR ART

Unfortunately, in the prior art design, the coin slots 208 also present an opportunity to defeat the rotary coin mechanism. FIG. 8 shows a section of an assembled rotary coin mechanism 100 to show the interaction of a detector detent 504 with a tool 804 and the filler disc 308 (the paired coin disc 204 is below the filler disc 308 and thus not visible). As shown in FIG. 8, a person seeking to get the vending product without paying would rotate the rotary handle 112 and connected components a small amount without inserting a coin into the coin slot 208 (shown as an outline as it is below the filler disc 308. This small rotation allows the coin slots 208 to pass the coin opening 108 of the front housing 104, allowing for insertion of a tool 804 (such as a bent paperclip) into the interior of the rotary coin mechanism 100. Once the tool 804 has been inserted into the empty coin slot 208, pushing forward with the tool 804 while rotating the rotary handle 112 brings the tool 804 into contact with the detector detent 504 to keep the detector detent 504 from engaging with the empty coin slot 208 to prevent further rotation of the rotary handle 112. FIG. 8 shows the process after the empty coin slot 208 has been successfully rotated past the detector detent 504. After the trailing edge of the coin slot 208 has passed the front edge of the detector detent 504, the tool 804 can be pulled back out of the rotary coin mechanism 100 and the assembly can be rotated the full 360 degrees to cause the machine to vend the product or service.

For vending items that require more than one coin to vend, then the process described above would be done for each of the coin discs requiring a coin.

With the existing rotary coin mechanism being used in a great number and variety of vending machines, many people come in contact with this device. The fact that the prior art coin mechanism can be easily defeated, and the details on how to defeat this coin mechanism are rapidly becoming common knowledge. A coin mechanism that is easily defeated with readily available tools renders very expensive vending machines or other service machines unprofitable to operate in areas without close supervision.

It is, therefore, an object of the present invention to prevent the maintained presence of a theft tool in the casing during rotation of the rotary coin mechanism to prevent interference with the coin detection system and thus prevent this type of theft of vending products.

It is an object of the present invention to provide an improved rotary coin mechanism that is resistant to attempts to distort the shape of the mechanism by "flexing" the mechanism as part of an attempt to obtain product without insertion of the appropriate coins.

It is further object to provide a solution that can be used to upgrade or replace existing rotary coin mechanisms by designing an improved coin mechanism that is compatible with existing rotary coin mechanisms.

These and other advantages of the present invention are apparent from the drawings and the detailed description that follows.

SUMMARY

The present invention is directed to an apparatus that satisfies the need to prevent thieves from using a simple tool to defeat the rotary coin mechanism in order to receive product without proper payment.

As the problem is the insertion of tools into the rotary coin mechanism, a conventional approach to the solution would be to attempt to block the insertion of the tool into the coin mechanism. This is a difficult task given the large amount of clearance available for tool insertion as an empty coin slot is rotated into the leading edge of the casing.

The present invention is based on the recognition that the solution to this problem is not in preventing the insertion of a theft tool, but the prevention of the continued presence of the inserted theft tool as the rotary coin mechanisms rotates through past the coin detector. Thus, the solution is to force the removal of the inserted theft tool before the rotary coin mechanism rotates beyond the scrutiny of the coin detector.

The present invention can be used to upgrade or replace the prior art coin mechanism that is widely used in industry where automated dispensing or services exist. As described above, the prior art rotary coin mechanism consists of a set of one or more coin discs that rotate about a central cam. An example of such a mechanism is the rotary coin mechanism available from Edina Technical Products, Inc. of Plymouth Minn. (www.edinatech.com).

The present invention is an improved rotary coin mechanism with coin discs having tabs located near the trailing edges of the one or more coin slots present on each coin disc. The tabs shaped to prevent the continued presence of a theft tool in the casing of the rotary coin mechanism during the rotation of the relevant coin slot past the coin detector. The tabs are shaped so that the tab can pass by the coin detector. For retrofit applications, the tabs are sized so that they can be slid onto the stack of components without interference from the casing or other components. In one preferred embodiment, the leading edge of the coin detector casing is reinforced with an external brace to reduce the potential for a thief to distort the shape of the casing in an attempt to extend the amount of coin disc rotation before the theft tool must be removed.

DETAILED DESCRIPTION OF THE PREFERRED EMBODIMENT

The present invention will now be described more fully hereinafter with reference to the accompanying drawings, in which preferred embodiments of the invention are shown.

This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
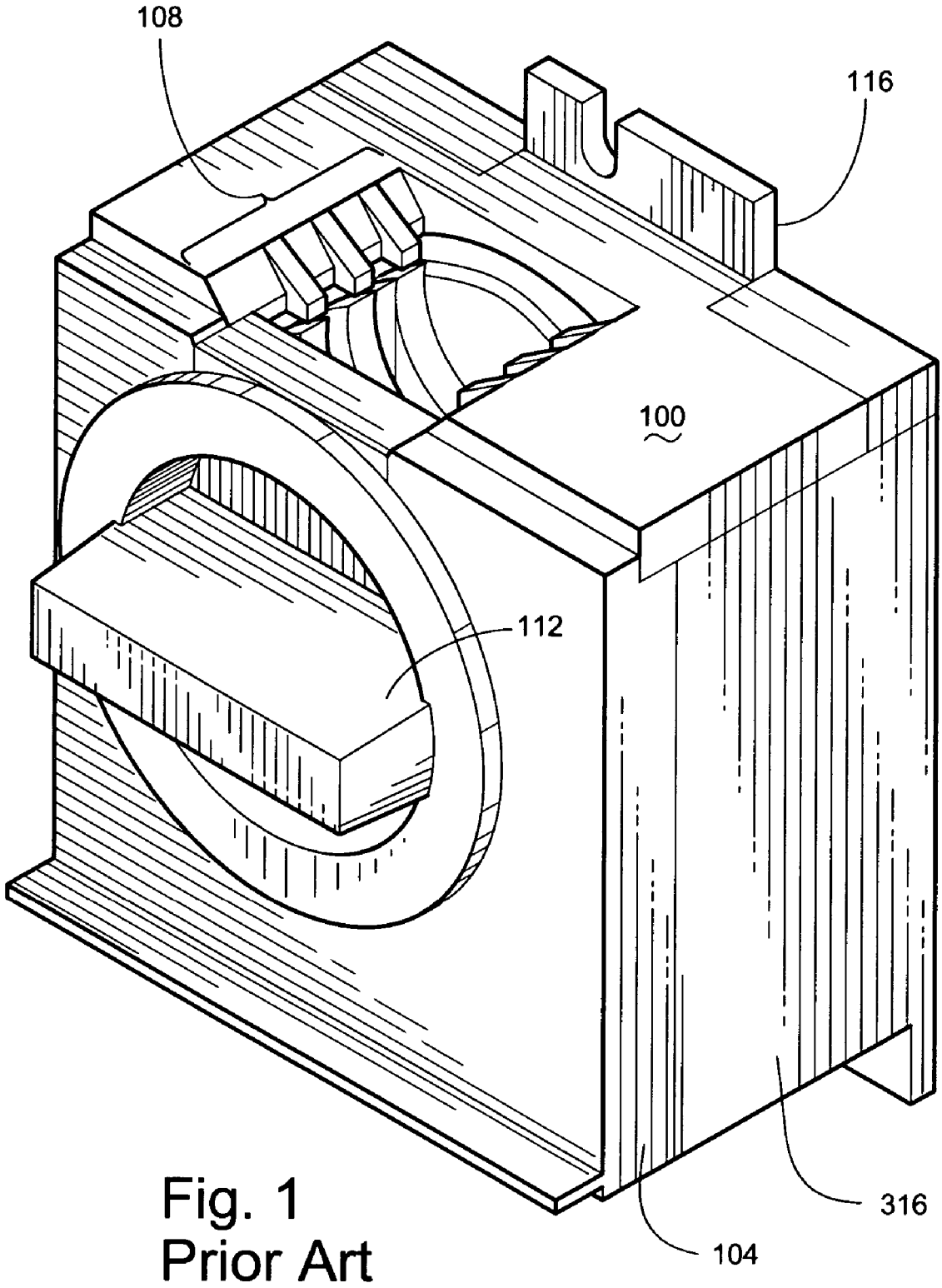
Fig. 1 Prior Art
FIG. 1 shows the external housing of the prior art rotary coin mechanism, the rotary handle, and the coin opening.
Figure 2:
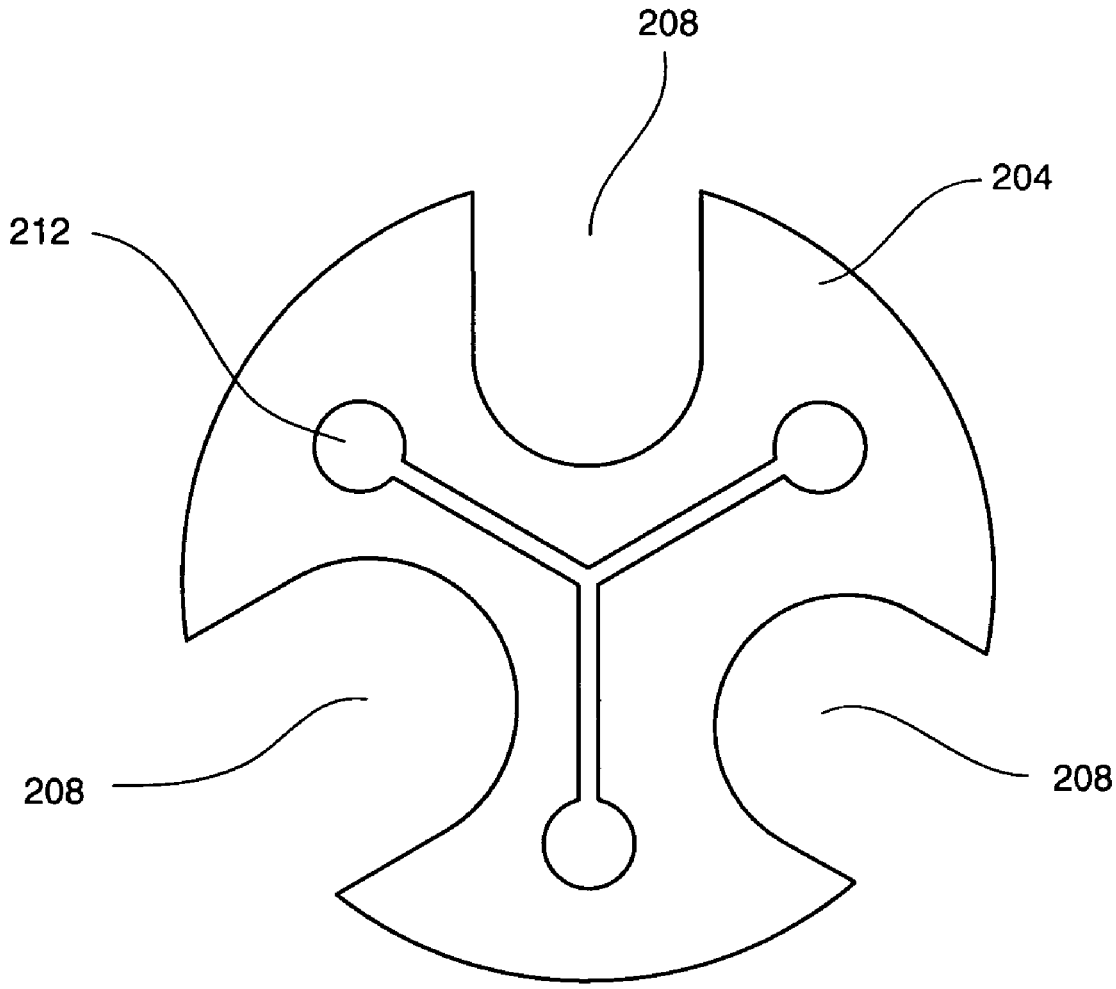
Fig. 2 Prior Art
FIG. 2 shows a detail of the prior art coin disc.
Figure 3:
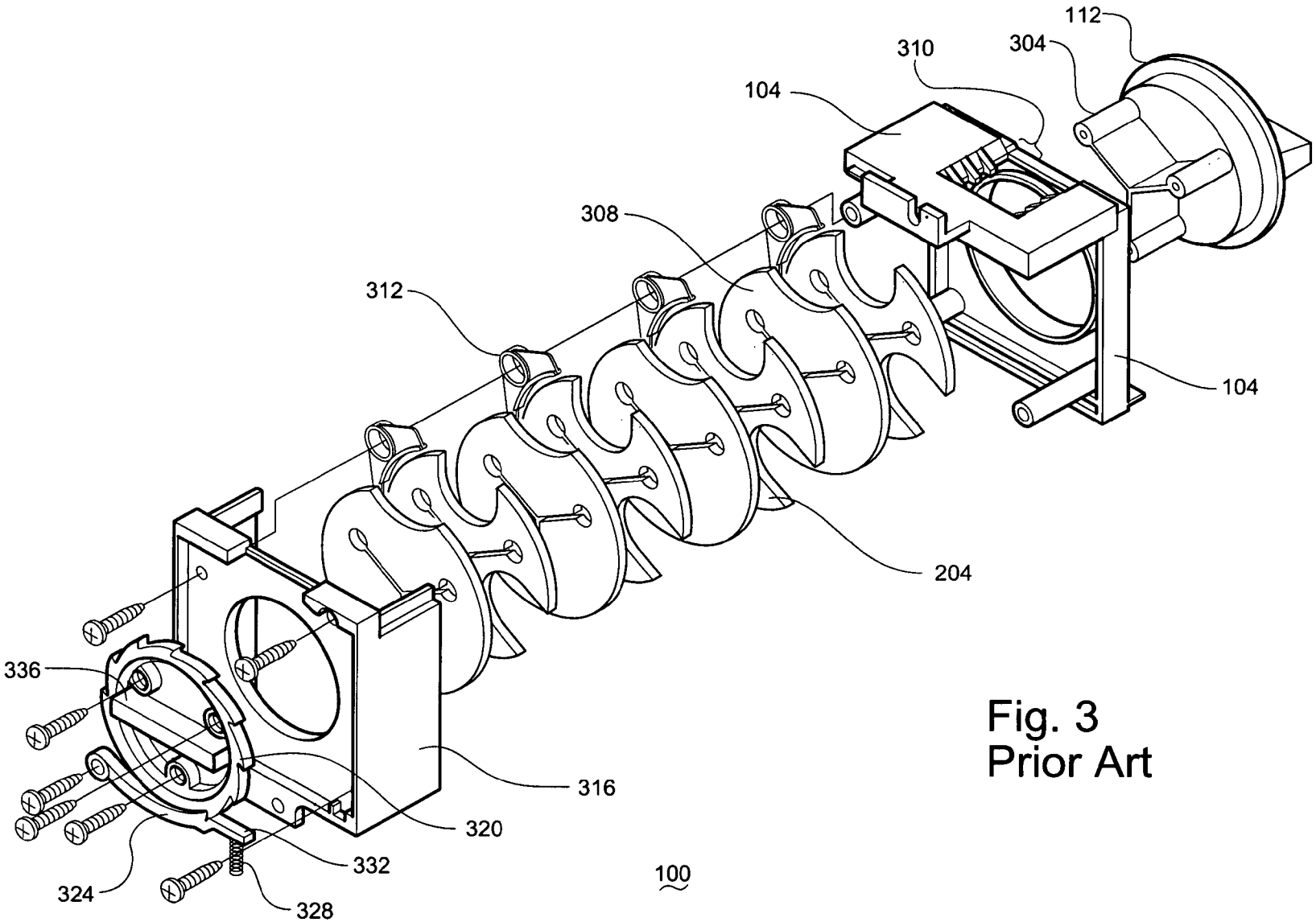
Fig. 3 Prior Art
FIG. 3 shows an exploded view of the entire prior art rotary coin mechanism.
Figure 4:
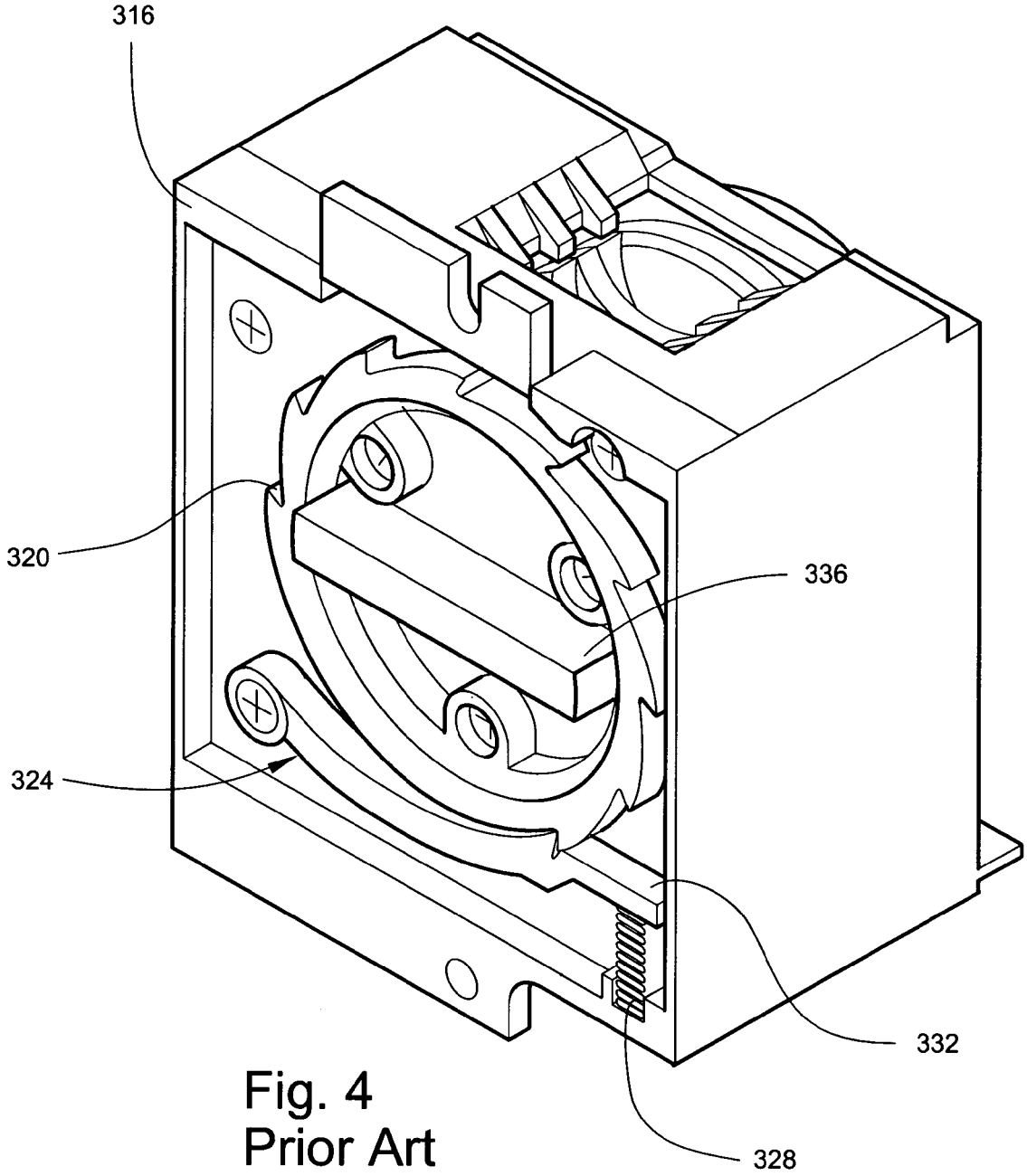
Fig. 4 Prior Art
FIG. 4 shows the prior art rotary coin mechanism from the back showing the ratchet and pawl system to prevent reverse rotation.
Figure 5:
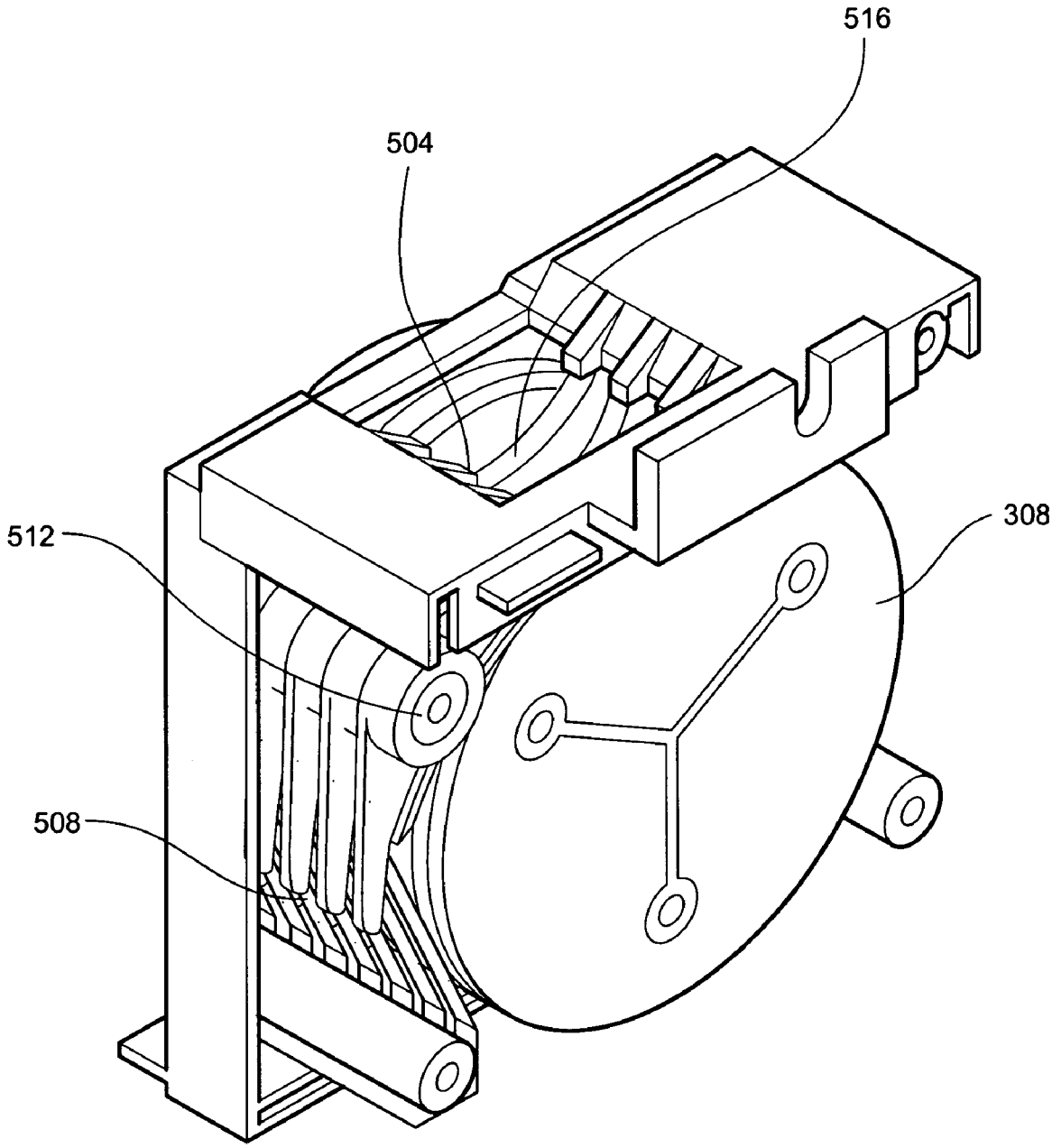
Fig. 5 Prior Art
FIG. 5 shows the prior art coin mechanism with the back removed, showing the coin discs and detector detents.
Figure 6:
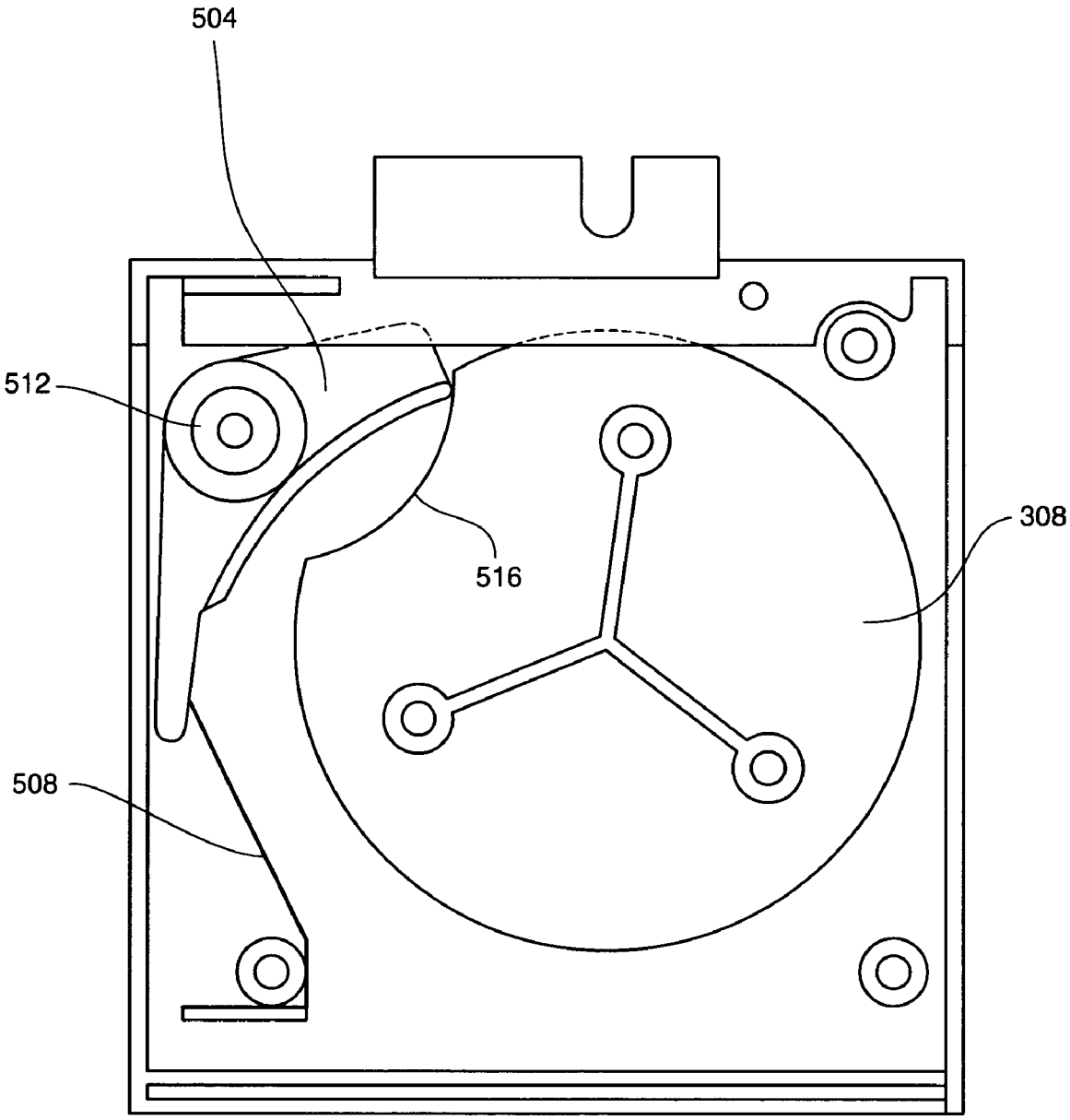
Fig. 6 Prior Art
FIG. 6 shows the inside of a prior art coin mechanism as viewed from the back to show an empty coin slot will cause the detector detent to stop the rotation of the rotary handle and connected components.
Figure 7:
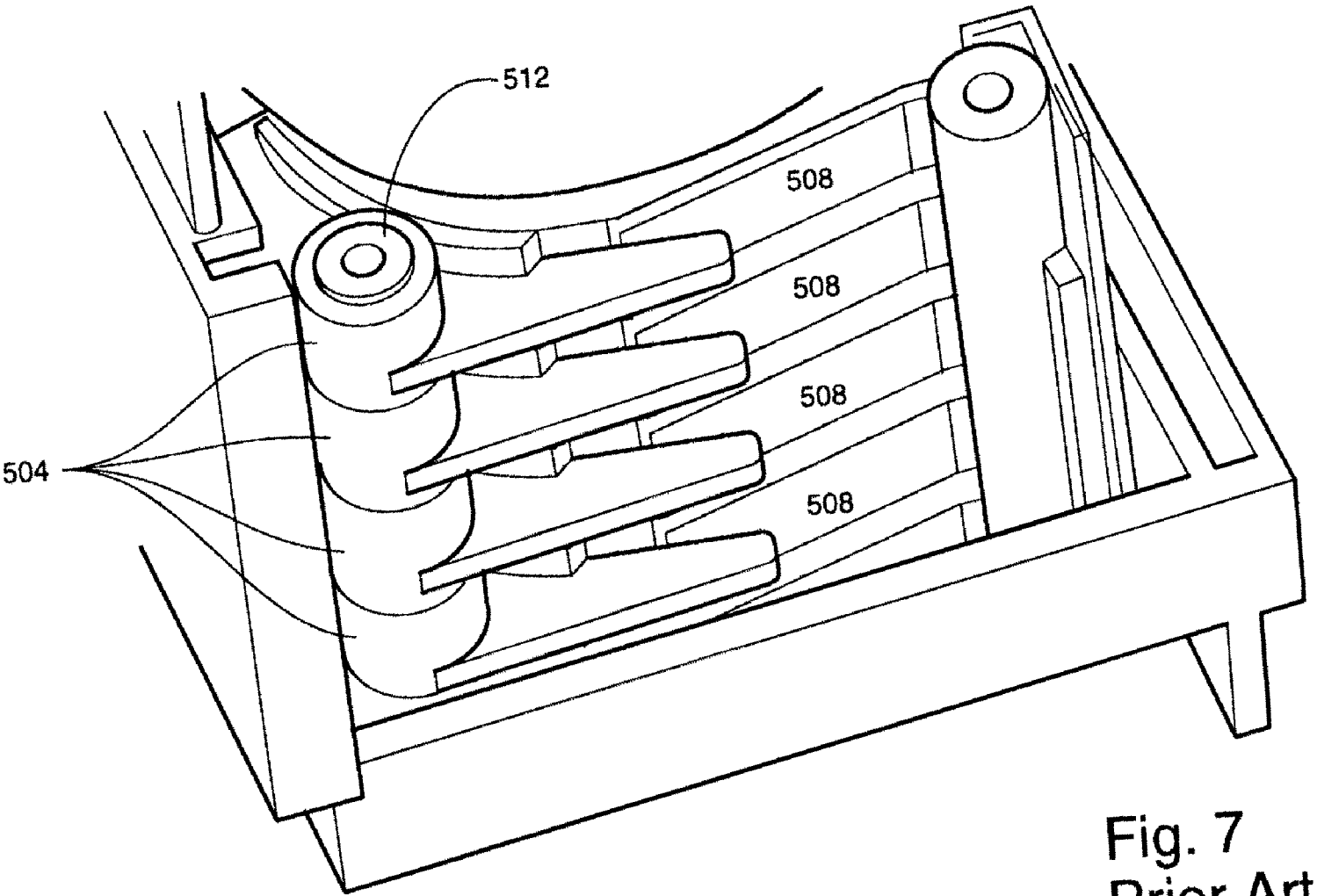
Fig. 7 Prior Art
FIG. 7 shows the positioning of four detector detents within the prior art rotary coin mechanism housing for a rotary coin mechanism programmed to require four coins.
Figure 8:
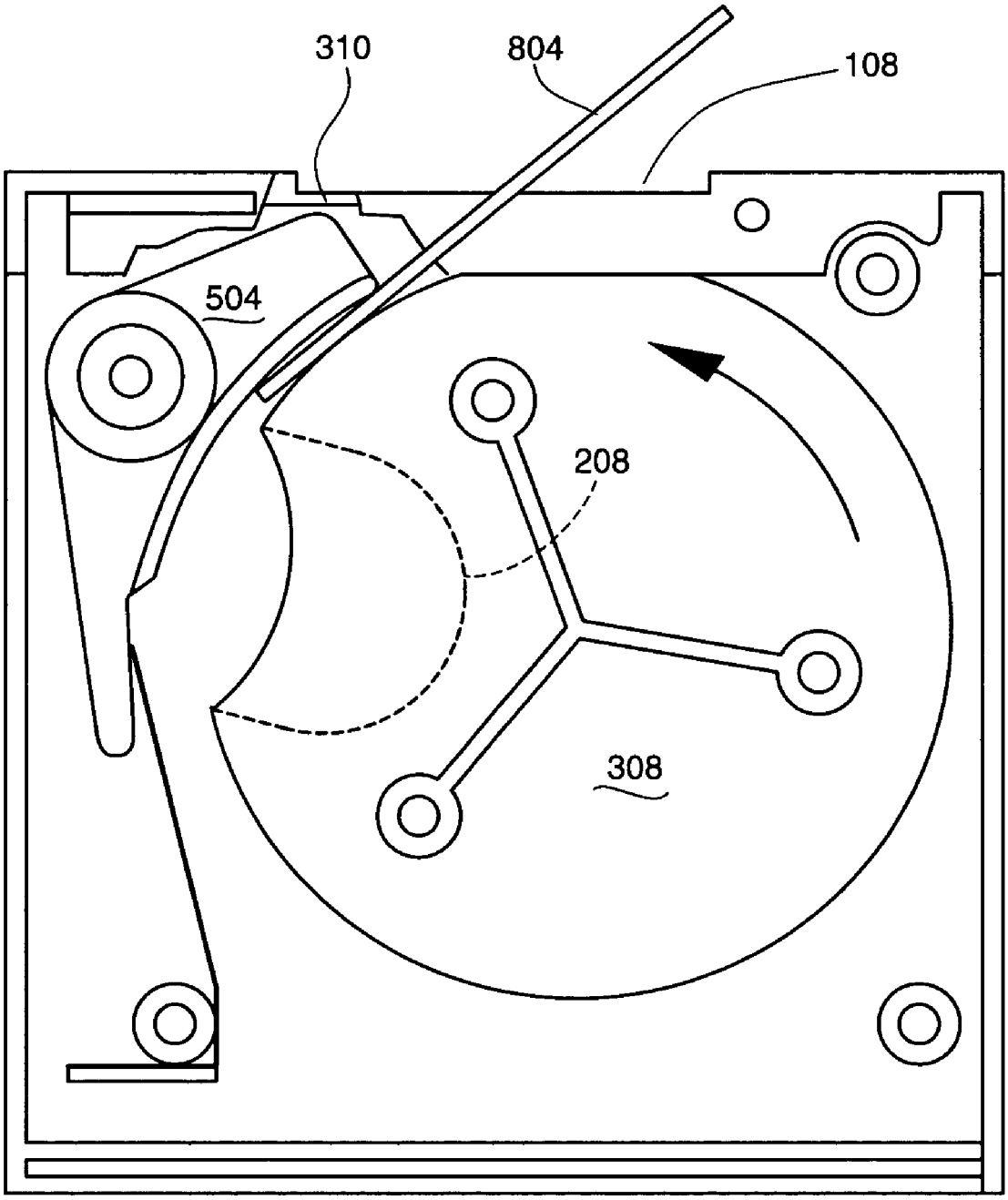
Fig. 8 Prior Art
FIG. 8 shows the inside of a prior art coin mechanism as viewed from the back to show the prior art rotary coin mechanism lever being defeated by the simple tool.
Figure 9A:
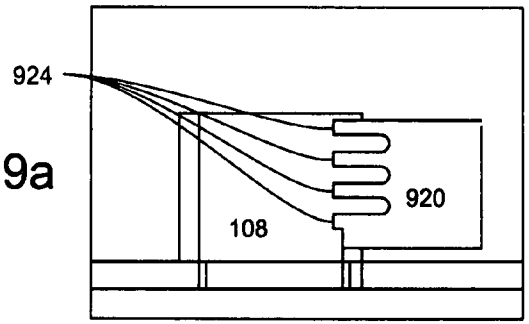
FIG. 9 shows various views illustrating features of an embodiment of the present invention, including a view of the inside of a modified device as viewed from the front.
Figure 9C:
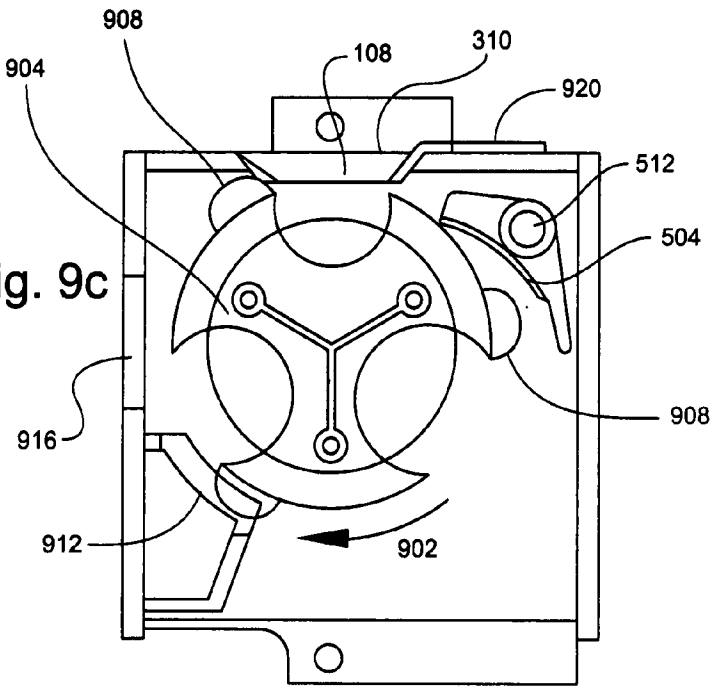
Figure 9B:
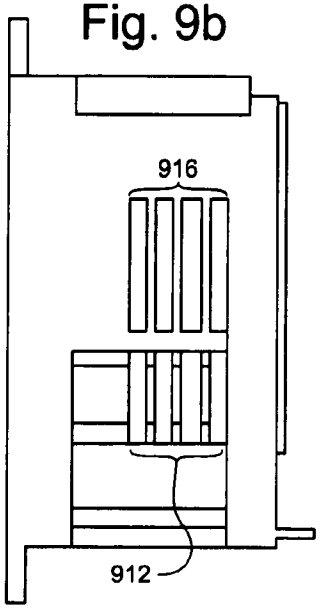

The present invention thwarts the use of a tool to interfere with the operation of the detector detent through the use of one or more modifications. FIG. 9 shows the internals of the improved design from the top, left side, and from the front rather than from the rear. Arrow 902 shows the direction of rotation. In order to avoid undue clutter, elements of the rotary coin mechanism not required for the display of the solution to the theft problem are omitted from FIG. 9. As illustrated in FIG. 9, the first modification is the use of improved coin discs 904 with tabs 908 on the trailing edges of all coin slots 208 on all coin discs 904 in the improved rotary coin mechanism. When the consumer rotates the rotary handle 112 and connected assembly, the gap between the casing and the coin slot that is used for the tool's penetration of prior art designs is filled and blocked by the added tabs 908. Blocking the gap prevents the thief from using the tool 804 (FIG. 8) to push and hold back the detector detent 504 until the empty coin slot rotates past the defective detent 504 (or levers if attempting to use multiple tools to defeat multiple detector detents). In some applications the tab height may be approximately 0.10 inches.

Those of skill in the art will recognize that the size, shape, and placement of the tabs may be modified somewhat. For example, the tab may not need to start at the edge of the coin slot as long as it is near enough to the trailing edge of the coin slot to serve the purpose of preventing the maintained presence of a tool to interfere with the coin detection process. Likewise, the shape of the tab could be different from that shown in FIG. 9 as long as the tab is sufficiently sized to block the use of a tool to interfere with the coin detection mechanism. In general the height of the tab near the trailing edge of the coin slot should be sufficient so that there is insufficient clearance between the top of the tab and the casing where the tab rotates into the casing from the coin opening to allow the insertion of a tool thick enough to push the coin detector mechanism out of position. Note that the actual clearance can be somewhat larger as the length of the tab combined with the reduced clearance serves as the barrier to the continued presence of the theft tool during the rotation through the critical range.

Within limits, a longer tab provides a greater obstacle to the maintenance of the theft tool. However, when retrofitting existing rotary coin mechanisms with new coin discs 904, there are limits on the maximum length of the tabs as the coin discs are assembled in a stack on the handle protrusions 304. Thus, tabs that must pass through grooves in the casing (as described below) must be placed in such a way that they can be stacked without having to interact during stacking with the grooved portions of the casing.

The leading edge of the tab will come in contact with the coin detector. It is important that the leading edge of the tab be shaped to allow the coin detector to ride up the tab rather than obstruct rotation of the coin disc as the coin detector interacts with an inappropriately shaped leading edge. While the leading edges shown in FIG. 9 are rounded, one of skill in the art could implement another shape such as a ramp.

As indicated in FIG. 9, any internal brackets for overall strengthening of the rotary coin mechanism need to be adjusted to allow for the rotation of the newly added tabs 908. For example, the internal brackets may have grooves 912 that allow the passage of the tabs (FIG. 9). FIG. 9 also shows that in some situations, the external casing will also require having grooves 916 cut into the casing to allow for the rotation of the newly added tabs.

Figure 10:
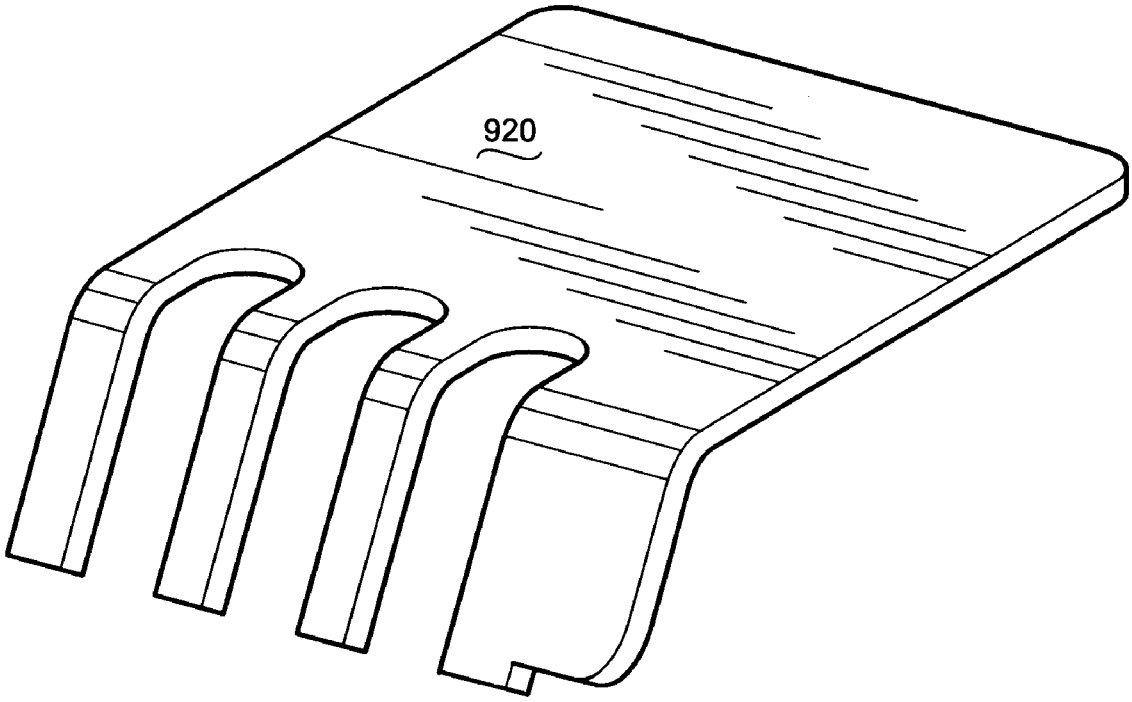
FIG. 10 shows the optional brace for use in reinforcing the leading edge of the casing of one prior art device.
Figure 11:
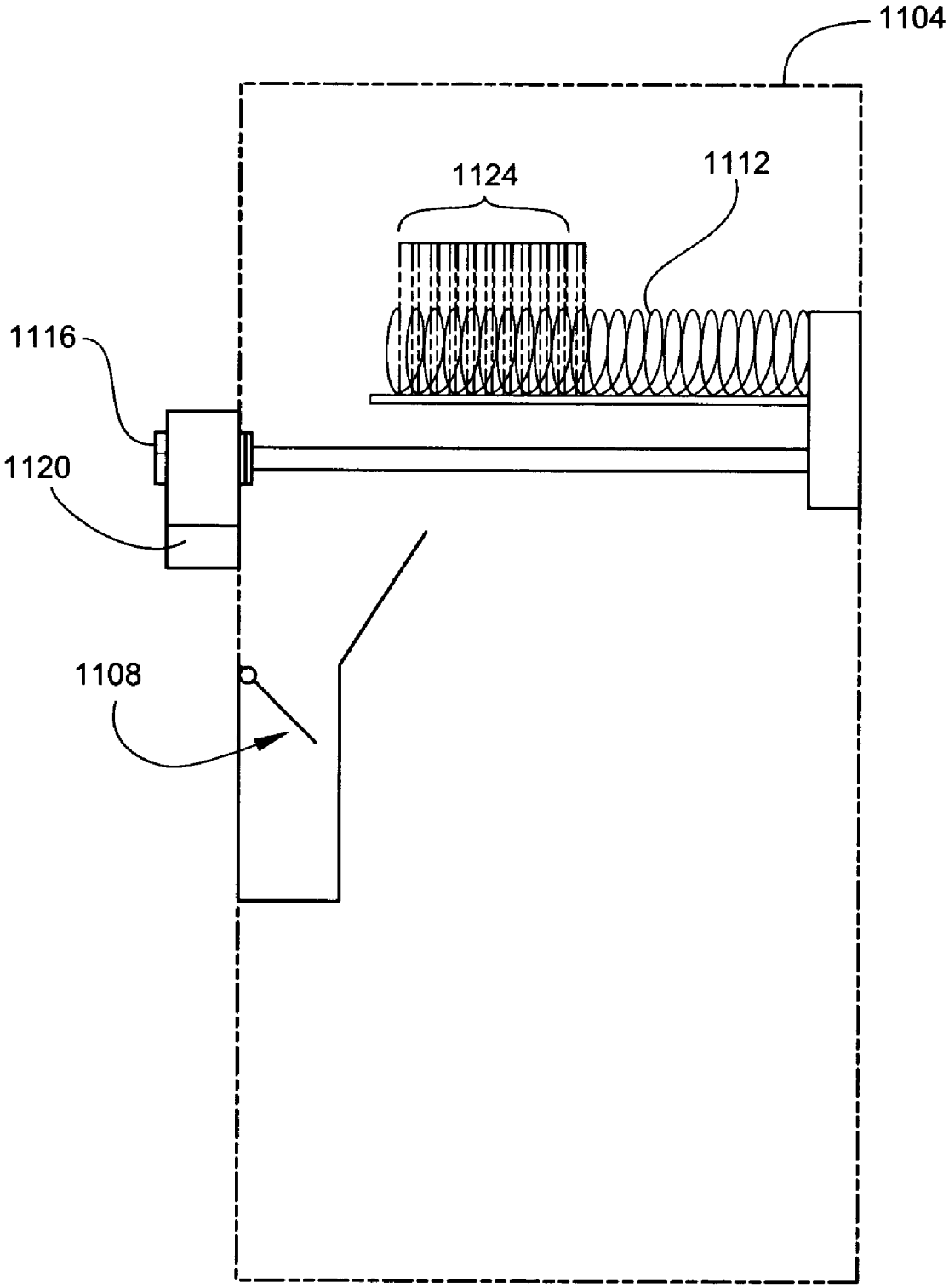
FIG. 11 shows the relevant components of a vending machine to provide the environment for the use of prior art or revised rotary coin mechanism.

As it is important to reduce the size of the gap so that a tool cannot be inserted and maintained during rotation, it may be important to reinforce the rotary coin device casing so that the casing cannot be distorted or flexed to change the gap. Thus FIG. 9 shows an optional additional brace 920 at the leading edge of the coin opening 108. FIG. 10 shows a perspective view of the brace 920. FIG. 11 provides additional views of the brace along with an example of dimensions for one brace to be used on a particular rotary coin mechanism. This brace 920 provides additional reinforcement to help prevent flexing of the casing between the coin discs and casing top. The actual shape of the brace would be based on the particular rotary coin mechanism. For example, the four fingers 924 of brace 920 fit around the existing ribs in front housing 104. A rotary coin device without these fingers could have a brace with a flat edge without any fingers. It is useful to have a tight tolerance with the top of the coin discs 204 away from the coin slots 208 so that the brace provides an additional obstacle to the maintained presence of a theft tool in addition to stiffening the casing to reduce the potential for flexing the casing.

The brace 920 may not be necessary if the casing of the rotary coin mechanism is manufactured of a material sufficiently resistive to attempts to flex the casing such that the casing cannot be readily flexed to allow a tool to interfere with the operation of the detector detents 504 despite the addition of the tab or tabs.

The rotary coin mechanisms are mounted on vending machines in many different configurations. The rotary coin mechanisms may be mounted upright on the front of the vending machines 1104 for dispensing of vending items 1124 stored inside the vending machine 1104. These products are vended through openings on the front of the vending machine. The rotary coin mechanisms can also be mounted on the side of the vending machine at varying angles to allow vending of products stored in rows across the front of the vending machine. These products may be vended by attaching a large coil 1112 to the rotary coin mechanism. Product to be vended 1124 would be inserted in between the turns of the large coils. Turning the rotary coin mechanism cam 360 degrees causes the coil 1112 to also rotate 360 degrees, and force the product inserted in the last loop of the coil to become free of the coil, and drop into a channel. This vertical channel would drop the vended product into an open chamber at the bottom of the vending machine, from which the buyer would retrieve the product.

The existing rotary coin mechanisms are mostly attached to vending machines in rows or columns. In some cases one rotary coin mechanism can be used to vend several different vending machines items. See, for example, U.S. Pat. No. 5,337,876 for a Counter-Top Vending Machine.

Each unique rotary coin mechanism is secured to the vending machine with several mounting screws. The rows or columns of rotary coin mechanisms are then secured by a cover plate that prohibits access to the rotary coin mechanism's mounting screws. These cover plates have very tight clearance tolerances over the rotary coin mechanisms. The improved coin mechanism must have the same external dimensions as the prior art coin mechanism in order to be compatible with these existing cover plates, and assure backwards compatibility with the multitude of existing rotary coin mechanisms.

VARIATIONS AND ALTERNATIVE EMBODIMENTS

In addition to the variations and alternative embodiments suggested above, it may be worth mentioning that the present invention is not limited to coin discs with one or three coin slots. These examples were used in keeping with common practice in the United States. Tabs can be added in accordance with the teachings of the present invention to a single coin slot or to two or more coin slots as is useful for the coinage of a particular country.

The teachings of the present invention can be used in a rotary coin mechanism that uses only one, two or three coin discs or uses more than the four coin disc mechanism used as an example above.

The teachings of the present invention can be employed in other rotary coin mechanisms that have alterative means for detecting the presence of an appropriate coin. The precise detector detent, post, and detector spring system is useful for explaining the problem and solution but is not required for the implementation of the invention. The invention can be applied to any rotary coin mechanism that can be defeated by inserting a tool into the interior of the rotary coin mechanism through an empty coin slot and holding the tool in place during the rotation of the rotary coin mechanism to defeat the coin detection system from stopping the vending of product or service for failure to insert the appropriately sized coin. An implementation of the present invention to prevent the defeat of a photo beam based coin detector could be within the scope of the present invention if the requisite claim elements are all present.

While the rotary coin mechanisms tend to be designed to operate exclusively on the manual rotation of the rotary handle and connected assembly, the invention does not require an absence of other means. Thus, for example, a rotary coin mechanism with electrical components could be within the scope of the present invention if the requisite claim elements were all present.

While the explanation of the operation of the rotary coin mechanism has used a rotary coin mechanism that rotates clockwise (viewed from the front) 360 degrees to vend the product, it is not necessary that the rotation be clockwise as opposed to counter clockwise or that the necessary amount of rotation is 360 degrees. Those of ordinary skill in the art can create rotary coin mechanisms that must rotate some other amount.

In fact, those skilled in the art will recognize that the methods and apparatus of the present invention have many applications and that the present invention is not limited to the specific examples given to promote understanding of the present invention. Moreover, the scope of the present invention covers the range of variations, modifications, and substitutes for the system components described herein, as would be known to those of skill in the art.

The legal limitations of the scope of the claimed invention are set forth in the claims that follow and extend to cover their legal equivalents. Those unfamiliar with the legal tests for equivalency should consult a person registered to practice before the patent authority which granted this patent such as the United States Patent and Trademark Office or its counterpart.

What is claimed is:

1. An improved rotary coin mechanism for the receipt of a payment made with at least one coin, the coin mechanism of the type comprising:

a stack of at least one coin disc within a coin mechanism casing, each coin disc having at least one open coin slot intended to receive a coin of a specific diameter, the stack connected to the coin mechanism in a manner adapted for at least 360 degree rotation in one direction when the each coin slot requiring a coin is filled with a coin of the required size such that each rotating coin prevents the operation of a coin detector mechanism from stopping the forward rotation of that coin disc, wherein the improvement comprises:

adding at least one tab to each coin disc near the trailing edge of at least one coin slot, the tab extending radially outward to extend the coin disc such that rotation of the tab on the trailing side of each coin slot through an opening in the leading edge of the casing prevents the maintained presence of a theft tool of sufficient size to interfere with the operation of the coin detector mechanism such that the theft tool cannot maintain contact with the coin detector mechanism for a sufficient range of rotation for the coin slot lacking a required coin of a specific diameter to be rotated past the coin detector mechanism.

2. The improved rotary coin mechanism of claim 1 further comprising an additional brace to be added to the exterior of the coin mechanism casing, the brace serving to reinforce the leading edge of the coin mechanism casing to resist the creation of an artificially enlarged gap between the at least one tab and the corresponding leading edge of the casing through the forced flexing of the casing.

3. The improved rotary coin mechanism of claim 1 wherein the at least one tab is shaped with a leading edge that will allow the tab to rotate past a coin detector detent without engaging the coin detector detent when the coin slot associated with the tab has a required coin of the prescribed specific diameter.

4. An improved rotary coin mechanism for the receipt of a payment made with at least one coin, the coin mechanism of the type comprising:

at least one coin disc with at least one coin slot, the at least one coin disc capable of a prescribed amount of rotation in one direction when each coin disc contains a coin of a required diameter in each coin slot requiring a coin such that each rotating coin prevents the operation of a coin detector mechanism from stopping the forward rotation of that coin disc for lack of a required coin of the required diameter, wherein the improvement comprises:

adding at least one tab to each coin disc near the trailing edges of at least one coin slot, the tab extending radially outward to extend the coin disc such that rotation of the tab through a corresponding opening in the casing obstructs continued use of a modified paperclip intended to prevent the operation of the coin detector mechanism from stopping the forward rotation of that coin disc for lack of the required coin of the required diameter, such that the coin disc lacking a coin of required diameter cannot be rotated past the coin detector mechanism as any modified paperclip with sufficient diameter to defeat the coin detector mechanism must be removed to allow rotation of the coin slot beyond the coin detector mechanism.

5. The improved rotary coin mechanism of claim 4 further comprising an additional brace to be added to the exterior of the coin mechanism casing, the brace serving to reinforce the leading edge of the coin mechanism casing to resist the creation of an artificially enlarged gap between the at least one tab and the corresponding leading edge of the casing through the forced flexing of the casing.

6. The improved rotary coin mechanism of claim 4 wherein a leading edge of the at least one tab is rounded to allow the tab to rotate past a coin detector detent without engaging the coin detector detent when the coin slot associated with the tab has a required coin of the prescribed diameter.

7. A vending machine comprising:

a housing having a hollow interior and an access point for retrieving a vended item;

at least one large coil rotated by the manual rotation of a rotary coin mechanism, the rotation of the large coil by a prescribed amount causing an auger motion to cause an item for vending to move from a resting position between turns of the large coil to a fall to the access point for retrieving vended items;

the coin mechanism comprising:

a casing;

at least one coin disc with at least one coin slot, the at least one coin disc capable of a prescribed amount of rotation in one direction when the coin disc contains a required coin of a required diameter such that the rotating coin prevents the operation of a coin detector mechanism from stopping the forward rotation of that coin disc for lack of a required coin of the required diameter;

wherein each coin disc further comprises:

at least one tab on each coin disc near the trailing edge of the at least one coin slot, the tab extending radially outward to extend the coin disc such that rotation of the tab through an opening in the casing prevents the maintained insertion of a theft tool in an inserted position effective for defeating the coin detector mechanism throughout the rotation of the coin slot past the coin detection mechanism.

8. The improved vending machine of claim 7 further comprising an additional brace to be added to the exterior of the coin mechanism casing, the brace having at least one opening corresponding to at least one tab added to the at least one coin disc, the brace serving to reinforce the coin mechanism casing to resist the creation of an artificially enlarged gap between the at least one tab and the corresponding leading edge of the casing through the forced flexing of the casing.

9. The improved vending machine of claim 7 wherein the at least one tab is shaped with a leading edge that increases in radial height gradually to allow the tab to rotate past a coin detector detent without engaging the coin detector detent when the coin slot associated with the tab has a required coin of the prescribed diameter.

10. A kit for upgrading a rotary coin mechanism to make the rotary coin mechanism more theft resistant, the kit to be used with a rotary coin mechanism of the type having:

a stack of at least one coin disc within a coin mechanism casing, each coin disc having at least one open coin slot intended to receive a coin of a certain prescribed size, the stack connected to the coin mechanism in a manner adapted for at least 360 degree rotation in one direction when each one coin slot is filled with coins of the intended size such that each rotating coin of the prescribed size prevents the operation of a coin detector mechanism from stopping the forward rotation of that coin disc;

the kit comprising:

a replacement coin detector casing;

a set of at least one replacement coin disc, each coin disc having at least one open coin slot intended to receive a coin of a certain prescribed size, each coin disc having a set of at least one tab, with a tab positioned near a trailing edge of the at least one coin slot on the coin disc, the tab extending radially outward to extend the coin disc such that after substitution of the replacement coin disc for the previous coin disc, rotation of the at least one coin disc through an opening in the replacement coin mechanism casing obstructs the sustained use of a theft tool so that an inserted theft tool blocks additional forward rotation of the coin disc towards of the coin detector mechanism, the at least one tab further characterized by having a leading edge that will allow the tab to rotate past a coin detector detent without engaging the coin detector detent when the coin slot associated with the tab has a required coin of the prescribed diameter;

wherein:

the replacement coin mechanism casing has a set of at least one opening adapted to allow the rotation of each coin disc tab through the replacement coin mechanism casing; and the at least one tab ends before reaching the leading edge of the next coin slot such that a portion of the coin disc between the trailing edge of the tab and the leading edge of the coin slot has a radial height sufficiently low to rotate through the replacement casing without passing through the set of at least one opening in the replacement casing.

11. The kit of claim 10 further comprising a brace to be added to the exterior of the coin mechanism casing, the brace serving to reinforce the replacement coin mechanism casing to resist the creation of an artificially enlarged gap between the tab and the leading edge of the replacement coin mechanism casing through the forced flexing of the replacement coin mechanism casing.

12. A method for modifying a rotary coin mechanism to reduce the vulnerability to theft from the sustained presence of an inserted theft tool which interferes with the ability of an internal coin detector from stopping the rotation of a coin disc lacking a coin of the prescribed size in a required coin slot, the method comprising;

Creating at least one modified coin disc with a tab extending radially outward from a zone near the trailing edge of at least one coin slot in the coin disc, the tab of sufficient radial height and covering a sufficient arc on the circumference of the coin disc to block the forward rotation of the coin disc in an assembled rotary coin mechanism towards the corresponding coin detector mechanism if a theft tool remains sufficiently inserted in the rotary coin mechanism to interfere with the operation of the coin detector mechanism so that an inserted theft tool cannot be maintained in a sufficiently inserted position to defeat the coin detector from stopping the continued rotation of a coin slot lacking a required coin of prescribed size, the leading edge of the tab adapted to avoid engagement with a coin detector detent when the coin slot associated with the tab has a required coin of the prescribed diameter; and assembling the modified rotary coin mechanism using the at least one modified coin disc.

13. The method of claim 12 further comprising the step of modifying the rotary coin mechanism to allow each tab sufficient clearance to rotate the prescribed amount to allow an assembled and in-service rotary coin mechanism to repeatedly vend products in response to insertion of required coins.

14. The method of claim 13 wherein the step of modifying the rotary coin mechanism comprises adding at least one groove to a rotary coin mechanism casing so that the tab passes through the groove in the rotary coin mechanism casing during prescribed rotation of the tab and its coin disc.

15. The method of claim 13 wherein:

the step of creating a modified coin disc is further characterized in that the at least one tab ends before reaching the leading edge of the next coin slot such that a portion of the coin disc between the trailing edge of the tab and the leading edge of the coin slot has a radial height sufficiently low to rotate through the modified rotary coin mechanism without passing through the portion modified to allow passage of a tab;

the step of assembling the modified rotary coin mechanism using the at least one modified coin disc comprises placement of the at least one modified coin disc on a cam assembly to be rotated within the modified rotary coin mechanism and the modified coin disc is initially placed on the cam assembly in a position that does not require the at least one tab to be initially positioned in a portion of the modified rotary coin mechanism that was modified to allow passage of the tab.

16. The method of claim 12 further comprising mounting the modified rotary coin mechanism in operational contact with a vending machine so that operation of the modified rotary coin mechanism loaded with all required coins of prescribed size provides input to the vending machine to cause delivery of a vended item to a place accessible to a customer of the vending machine.

17. The method of claim 12 wherein the step of modifying the rotary coin mechanism further comprises adding an external brace to the external surface of the rotary coin mechanism to reinforce the rotary coin mechanism where the leading edge of the coin slot enters into the rotary coin mechanism when rotated in the direction required to cause product to vend.

* * * * *